United States Patent [19]

Lane

[11] 4,199,657

[45] Apr. 22, 1980

[54] PLANAR SOUND REPRODUCING SPEAKER SYSTEM

[76] Inventor: Harvey Lane, 1046 E. Vernon, Los Angeles, Calif. 90011

[21] Appl. No.: 926,892

[22] Filed: Jul. 21, 1978

[51] Int. Cl.[2] ..... H04R 5/02; H04R 1/02

[52] U.S. Cl. ..... 179/1 GA; 179/1 E; 181/145

[58] Field of Search ..... 179/1 GA, 1 G, 1 GP, 179/1 E, 1 D; 181/141, 144, 145, 147

[56] References Cited

U.S. PATENT DOCUMENTS

| | | | |
|---|---|---|---|
| 3,385,929 | 5/1968 | Magyar et al. | 179/1 GA |
| 3,752,258 | 8/1973 | Ishikawa | 181/145 |
| 3,824,343 | 7/1974 | Dahlquist | 181/144 |

FOREIGN PATENT DOCUMENTS

| | | | |
|---|---|---|---|
| 445765 | 4/1936 | United Kingdom | 181/144 |
| 781637 | 8/1957 | United Kingdom | 181/145 |
| 833707 | 4/1960 | United Kingdom | 181/145 |

*Primary Examiner*—Douglas W. Olms
*Attorney, Agent, or Firm*—Erik M. Arnhem

[57] ABSTRACT

A speaker system, comprising for each of its channels, a stand supporting a midrange unit, from the housing of which a plurality of tubular supports emanates radially and equidistantly, a tweeter unit mounted on the free end of each of the tubular supports, one self-contained lowrange (bass) commode containing a woofer unit, respectively for each of the channels: a cross-over network separating and feeding the various frequency ranges to the midrange, tweeter and woofer units.

4 Claims, 7 Drawing Figures

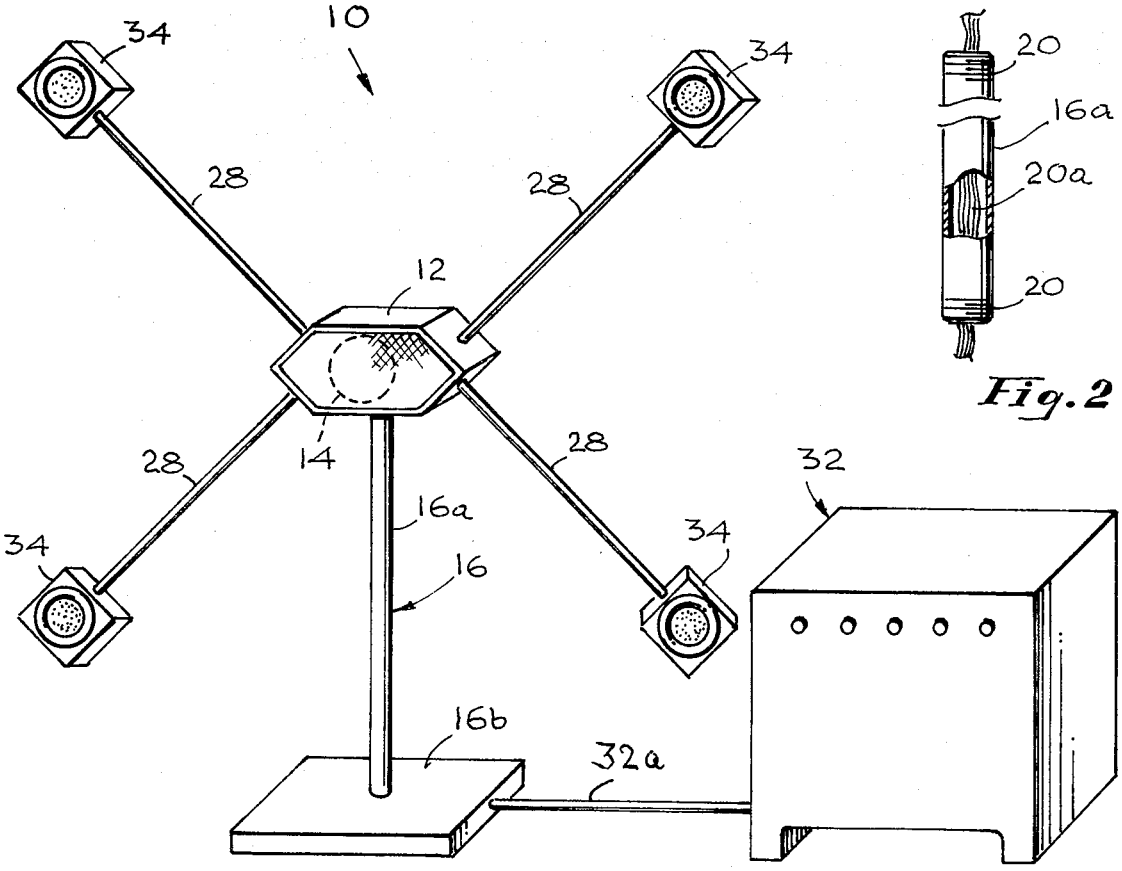
Fig. 1
Fig. 2
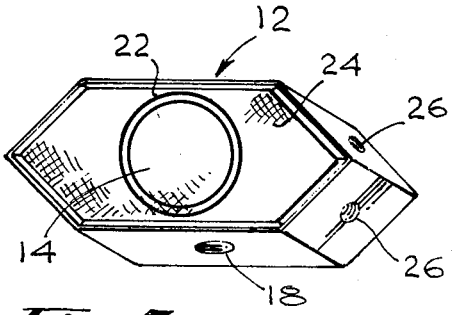
Fig. 3
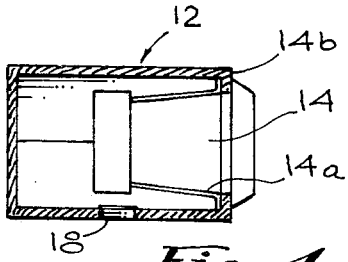
Fig. 4
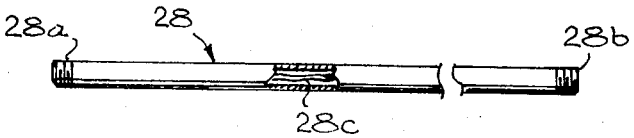
Fig. 5
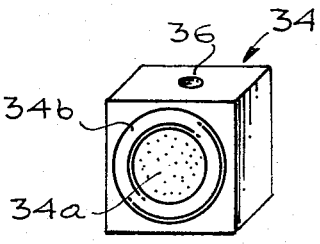
Fig. 6
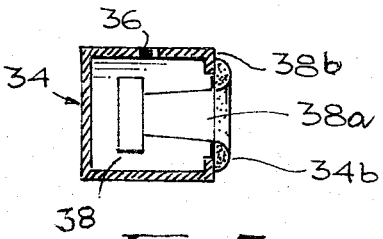
Fig. 7

PLANAR SOUND REPRODUCING SPEAKER SYSTEM

BACKGROUND OF THE INVENTION

1. Field of the Invention

The invention relates to a speaker system which due to its unique construction and arrangement of midrange, tweeter and woofer units reproduces sound of a special spatial effect and eliminates or minimizes distortions inherent in conventional speaker systems.

2. Description of the Prior Art

The following U.S. patents constitute the prior art relevant to the application, as known to applicant.

| | | |
|---|---|---|
| Patent No. 3,931,867 | JANSZEN | 1976 |
| Patent No. 3,947,635 | FRANKMAN | 1976 |
| Patent No. 3,385,929 | MAGYAR | 1968 |

JANSZEN refers to a speaker system, in which midrange, woofer and tweeter components are compactly housed within a single speaker unit.

FRANKMAN concerns an integrated stero speaker system, having overtone and treble drivers in common enclosures mounted on vertical poles, flanking a bass enclosure placed in a co-planar position therewith.

MAGYAR is directed to a sterophonic system on a turntable unit.

None of the above cited patents discloses a speaker system, having separate self contained woofer, tweeter and midrange drivers and, therefore, should be considered irrelevant in determining the patentability of the present invention.

One of the major drawbacks of the conventional type speaker systems is that the drivers radiate the various frequencies in an artificially "localized" manner, so that the listener actually perceives e.g., the high frequency sounds as emanating directly from the tweeter and mid-frequencies from the midrange.

SUMMARY OF THE INVENTION

The present speaker system then was primarily conceived to bring about a "multiple point source" reproduction of sound, that is to say, a blending of the frequencies, so that they appear to generate uniformly over the entire plane of reproduced sound, having the listener experiencing an expansive area of music, coming to him from a large "sound screen" as it were. The sound, however, also appears to radiate from one point, as the sound from a sole musical instrument played in a concert hall actually would. The size of the sound screen is defined by the perimeter of the speaker units. The reasons underlying the above mentioned phenomenon is that, when a signal is fed to two identical drivers, it appears to radiate from a point centered and along a line drawn between them. In the speaker system, according to the invention, however, the center point between the four tweeters is also the center point of the midrange driver. Consequently, the high frequencies appear to radiate from the same point as the midrange, and from the entire plane, as defined by the positions of the tweeters.

In other words, the speaker system according to the invention overcomes the sonic characteristics of drivers, which substantially beam high frequencies in a straight line to the listener.

The speaker system, according to the invention, comprises, for each channel, a midrange speaker, mounted on an elevated base, from which tubular extensions radiate; the tweeters are mounted, respectively at the end of each of these tubular extensions; the woofers (one speaker for each channel) are enclosed within a separate floor commode. The entire speaker system is operated by way of a cross-over circuit.

The present invention then utilizes a speaker system, having the tweeters (for high frequency) completely isolated from one another and from the midrange and woofer drivers.

In so isolating the tweeters from each other, and from the midrange component, the resonance problems existing in conventional speaker systems, having the speakers within one cabinet, are also eliminated.

Furthermore, as a corollary to the complete separation of tweeter and midrange units, each of its drivers is mounted on a separate baffle board. This arrangement is of great benefit in suppressing distortions. A driver does not only radiate outwardly, but also along the baffle board, on which it is mounted. In the conventional speaker system all drivers are mounted on a common baffle board, and, therefore the sound wave front, which is generated by each driver will travel along the common baffle board and when encountering will modulate each other, causing distortions in the original sound front. In the present invention the use of completely isolated and separate baffle boards will eliminate such cross modulation distortions.

Finally, the "extended" esthetically pleasing construction of the speaker system, also does not block any object, such as e.g., pieces of furniture, located behind it.

It is, thus an object of the invention to provide a speaker system, which, due to the spatial isolation of its speakers, reproduces sound planarly, however without compromising the listener's perception of the musical instruments played.

It is a further object of the invention to provide a speaker system, which due to the spatial isolation of its drivers, eliminates distortions in the system.

It is still a further object of the invention to provide a speaker system, which due to its extended construction, does not block the view of any objects behind it and, at the same time, has an esthetically pleasing appearance.

BRIEF DESCRIPTION OF THE DRAWINGS

FIG. 1 is a perspective view of the speaker system, (for one channel) comprising midrange and tweeters; and one low frequency (bass) enclosure containing the woofers for the complete system.

FIG. 2 is a sectional view of a tubular portion of a support stand for the midrange driver.

FIG. 3 is a more detailed perspective view of the midrange housing of FIG. 1, FIG. 4 is a diagrammatic view of the midrange.

FIG. 5 is a sectional view of a tubular connection between midrange and tweeter units.

FIG. 6 is a perspective view of a tweeter housing, placed upside down.

FIG. 7 is a diagrammatic view of the tweeter.

DESCRIPTION OF THE PREFERRED EMBODIMENT

The following description refers to a three-way speaker system utilizing self-contained driver structures, arranged spatially apart. Its unique accoustic properties are mainly due to the specific spatial relationship between its drivers. Tweeters, midrange, woofer untis and cross-over circuit are, per se, well known in the art and, therefore not the object of the present invention. Any types of drivers and network, the structures of which are suitable for the invented speaker system, may be used.

In the drawings, like reference characters designate similar parts in the several views.

Referring now in detail to the drawings, numeral 10 of FIG. 1 designates one assembled unit of the midrange and tweeters (one channel) and common enclosure of woofers for the system. The cross-over network that feeds the speakers and divides the audio spectrum appropriately between the units, is not shown, as not being instrumental to properly describing the present invention.

Housing 12, containing a midrange driver 14, is mounted on a vertical tubular connection 16*a*, which in turn is supported by a base 16*b*, together constituting a stand 16. The bottom surface of housing 12 may, preferably be provided with a threaded bore 18, (FIG. 3) and the ends of tubular connection 16*a* with external threadings 20 so that one of its ends may be received and screwed into the former. The other threaded end of tubular connection 16*a* may similarly be screwed into a threaded bore (not shown) in base 16*b*, to form the complete stand 16. Housing 12 is shaped hexagonally in order to prevent standing waves, and is made of walnut veneered pressed wood. The front portion of housing 12 is provided with an opening 22, covered suitably with a double-knit fabric 24, functioning as a grill, behind which the midrange driver 14 is mounted within housing 12.

The preferred height of stand 16 is 34". The length and height of midrange housing 12 are approximately 10" and 8", respectively.

FIG. 4 shows diagramatically midrange 14, with cone 14*a* and baffleboard 14*b*. Appropriate electrical wiring 20*a* passes from a cross-over network (not shown) through tubular connection 16*a*, as shown in FIG. 2, to the midrange driver 14, feeding midrange frequencies to the latter.

Hexagonal midrange housing 12 is provided with four threaded bores 26 in its four sloping sides, each of which receives a tubular connection 28 (FIG. 5), one end of which having external threads 28*a* to be screwed thereinto. When all the tubular connections 28 are mounted, they will radiate perpendicularly from cabinet 12, and form 90° angles with housing 12 and one another (FIG. 1). The preferred lengths of the tubular connections 16*a* and 28 (FIGS. 2 and 5) are 34 and 30 inches, respectively. The free ends of each of the tubular connections 28 are also externally threaded at 28*b* (FIG. 5) in order to receive a tweeter housing 34, (FIG. 6) at its bottom surface, which is provided with a internal threaded bore 36 for fitting therewith. A tweeter 38 (FIG. 7) is housed within each of the housings 34.

FIG. 5 illustrates the tubular connection 28, provided with screw threads 28*a, b* at respective ends and a section of wiring 28*c* passing therethrough from tweeter 38 to the midrange 14, and connecting up with the cross-over circuit (not illustrated). The tweeter housing 38 (FIG. 6) is preferably made of walnut veneered pressed wood. Its front surface has an opening 34*a*, covered by a perforated domed screen 34*b*. The tweeter 38 housed therewithin is shown diagrammatically in FIG. 7, where 38*a* represents the driver and 38*b* the baffleboard. The tweeter housing has a square space with preferred dimensions of 5"×5"×5".

Thus, the midrange and each of the tweeter drivers are respectively, provided with separate baffleboards (14*b* in FIG. 4 and 38*b* in FIG. 7), as stated above. This arrangement is of great benefit in eliminating cross modulations distortions, as explained in more detail above.

The woofer components (not shown) are enclosed (with one woofer for each channel) in a separate commode 32, and connected to the speaker system by way of wiring means, shown schematically at 32*a*. Although, obviously, the woofers are parts of the speaker system in its entirety, it does not, per se, constitute any novel constructions. The woofers, reproducing frequencies below 100 cycles, are basically nondirectional, that is, they are unimportant subjectively, in localizing a sound source. Therefore, it could, when playing, generally be placed at any location in the room. The preferred dimensions of the commode 32 is about 19", 28" wide, and 28" deep.

The preferred location of two units (one for each channel) of midrange and tweeter satellites, is side by side and appropriately spaced apart.

By virtue of the unique arrangement of the midrange and tweeter components, according to the invention, the listener does not have to position himself inbetween the speakers, but may enjoy the full sound radiating across an expanded area, at a convenient distance from the speakers.

While the foregoing has illustrated and described what is now contemplated to be the best mode of carrying out the invention, the latter is, of course, subject to modifications without departing from the spirit and scope of the invention. Therefore, it is not desired to restrict the invention to the particular constructions illustrated and described, but to cover all modifications, that may fall within the scope of the appended claims.

I claim:

1. In a stereo speaker system, operable by way of a crossover circuit, comprising:

(a) an elongated stand;

(b) a housing of hexagonal configuration mounted on top of the stand;

(c) means for reproducing midrange frequency sound signals accommodated within the housing;

(d) a plurality of tubular sections mounted on and extending radially outward from the sides of the housing;

(e) a plurality of means for reproducing high frequency sound signals, mounted on the outer ends of the tubular sections, respectively;

(f) means for reproducing low frequency sound signals accommodated separately from the means for reproducing midrange and high frequency signal sounds;

(g) a crossover circuit wired for separating and delivering the appropriate range of frequencies to the means for reproducing the midrange, high and low frequency signal sounds, respectively.

2. A speaker system, according to claim 1, wherein four tubular sections radiate from and form 90° angles with the sides of the housing from which they, respectively, extend.

3. A speaker system, according to claim 2, wherein the tubular sections are mounted detachably on the sides of the housing.

4. A stereo speaker system operated by way of a crossover network, comprising for each channel:

(a) a base including a tubular section extending vertically upward therefrom;

(b) a hexagonally shaped midrange speaker mounted on the free end of the tubular section;

(c) four tubular sections mounted detachably to and extending radially and equidistantly, respectively, from center portions of the side surfaces of the midrange speaker so as to form 90° angles therewith;

(d) four tweeters mounted respectively to the free ends of the tubular sections;

(e) a woofer accommodated separately from the midrange speaker and tweeters;

(f) electric wiring means extending through the base to the midrange speaker, the tubular sections radiating from the midrange speaker to the tweeters, and to the woofer delivering, by way of the crossover network, mid, high and low frequency sound signals for reproduction to respectively, the midrange speaker, tweeters and woofer.

* * * * *